US009562661B2

(12) United States Patent
Kijima et al.

(10) Patent No.: US 9,562,661 B2
(45) Date of Patent: Feb. 7, 2017

(54) ILLUMINATION DEVICE AND VEHICLE HEADLIGHT

(75) Inventors: Hiroshi Kijima, Osaka (JP); Kensei Toyota, Osaka (JP); Koji Takahashi, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 0 days.

(21) Appl. No.: 13/487,993

(22) Filed: Jun. 4, 2012

(65) Prior Publication Data

US 2013/0003400 A1 Jan. 3, 2013

(30) Foreign Application Priority Data

Jun. 28, 2011 (JP) ..... 2011-143564

(51) Int. Cl.
*F21S 8/10* (2006.01)

(52) U.S. Cl.
CPC ..... *F21S 48/1159* (2013.01); *F21S 48/1388* (2013.01); *F21S 48/1394* (2013.01)

(58) Field of Classification Search
CPC F21S 48/1388; F21S 48/1208; F21S 48/1127; F21S 48/1195
USPC ..... 362/507, 510
See application file for complete search history.

(56) References Cited

U.S. PATENT DOCUMENTS

2005/0018147 A1 1/2005 Lee et al.
2005/0105301 A1 5/2005 Takeda et al.
2008/0013333 A1* 1/2008 Koizumi ..... B60Q 1/2696 362/511
2009/0284148 A1* 11/2009 Iwanaga ..... 313/506
2009/0316384 A1 12/2009 Kanayama et al.
2011/0063115 A1* 3/2011 Kishimoto ..... 340/600
2011/0194038 A1* 8/2011 Kimura et al. ..... 349/7
2011/0249460 A1* 10/2011 Kushimoto ..... 362/510
2012/0140501 A1* 6/2012 Nakazato et al. ..... 362/510
2013/0044503 A1* 2/2013 Mihara ..... F21S 48/1241 362/511

FOREIGN PATENT DOCUMENTS

JP 8-262437 10/1996
JP 2003-295319 10/2003
JP 2004-241142 8/2004
JP 2005-150041 6/2005
JP 2005150041 A * 6/2005
JP 2006-527416 11/2006
JP 2010-97863 4/2010
JP 2011-100631 5/2011
JP 2012119170 A * 6/2012
WO WO-2010/116305 10/2010

* cited by examiner

*Primary Examiner* — Sean Gramling
*Assistant Examiner* — Gerald J Sufleta, II
(74) *Attorney, Agent, or Firm* — Morrison & Foerster LLP

(57) ABSTRACT

A headlight of the present invention includes: a fluorescent material light-emitting section; a reflector that reflects light emitted from the fluorescent material light-emitting section so as to emit reflected light out of the headlight; and a mini-mirror that reflects, toward a predetermined surface of the fluorescent material light-emitting section provided substantially at a focal point of the reflector, at least part of light that has not been directed toward the reflector. The mini-mirror has its optical axis inclined with respect to a normal line of the predetermined surface.

15 Claims, 7 Drawing Sheets

ILLUMINATION DEVICE AND VEHICLE HEADLIGHT

This Nonprovisional application claims priority under 35 U.S.C. §119 on Patent Application No. 2011-143564 filed in Japan on Jun. 28, 2011, the entire contents of which are hereby incorporated by reference.

TECHNICAL FIELD

The present invention relates to an illumination device and a vehicle headlight, each of which uses a reflecting mirror to emit out illuminating light.

BACKGROUND ART

In recent years, a substantial amount of research has been conducted for an illumination device which emits, as illuminating light, fluorescence that is generated by irradiating a light emitting section containing a fluorescent material with excitation light emitted by an excitation light source (i.e. semiconductor light emitting element) such as an LED (Light Emitting Diode) or an LD (Laser Diode).

Also, in order to achieve a reduction in energy consumption in the light of environmental issues, there has been a demand for an increase in efficiency in use of light emitted from a light emitting element (such as an LED, an LD, a fluorescent material light-emitting section etc.) of an illumination device (hereinafter, referred to simply as light utilization efficiency).

A light source device disclosed in Patent Literature 1 uses, as illuminating light, visible light generated, as spontaneously-emitted light, by irradiating a fluorescent material with a laser beam. According to the light source device, there is provided, in front of the fluorescent material facing a direction in which fluorescence is to be emitted, an ultraviolet rays reflecting mirror serving as a laser beams reflecting mirror. This causes a laser beam, which has not been absorbed by the fluorescent material, to be reflected from the ultraviolet rays reflecting mirror so that the fluorescent material is irradiated again with reflected laser beam. This prevents, from being emitted outside, a laser beam which has not been converted by the fluorescent material into visible light. A laser beam, which (i) was reflected by the ultraviolet rays reflecting mirror and (ii) re-entered the fluorescent material, is converted by the fluorescent material into spontaneously-emitted light. This allows light utilization efficiency to be enhanced.

Furthermore, Patent Literatures 2 and 3 each disclose a light source including a lens that converges, onto a fluorescent material, light emitted from a semiconductor light emitting element.

CITATION LIST

Patent Literatures

Patent Literature 1
Japanese Patent Application Publication, Tokukai, No. 2003-295319 A (Publication Date: Oct. 15, 2003)
Patent Literature 2
Japanese Patent Application Publication, Tokukai, No. 2004-241142 A (Publication Date: Aug. 26, 2004)
Patent Literature 3
Japanese Patent Application Publication, Tokukai, No. 2005-150041 A (Publication Date: Jun. 9, 2005)

SUMMARY OF INVENTION

Technical Problem

It is understandable that the light source device disclosed in Patent Literature 1 can enhance efficiency in use of a laser beam, but Patent Literature 1 does not teach or suggest a configuration for enhancing efficiency in use of visible light generated by the fluorescent material.

The following description will discuss in detail light utilization efficiency of light generated by a fluorescent material.

FIG. 10 illustrates a configuration of a conventional illumination device, an illumination device 50. The illumination device 50 (i) controls, with the use of a reflector 5, distribution of light emitted from a fluorescent material light-emitting section 4 and (ii) emits out the light as illuminating light. The illuminating light is substantially parallel to an optical axis of the reflector 5.

Since light emitted from the fluorescent material emitting section 4 travels in all directions, part of the light is emitted out of the device from an opening of the reflector 5 without being reflected by the reflector 5. For example, light (a light beam 52 shown in FIG. 10), which is emitted in an obliquely upward direction outside a predetermined solid angle defined by the reflector 5, does not reach a target area to be illuminated, and is therefore wasted. Patent Literature 1 does not address such a problem of light emitted from the fluorescent material light-emitting section, not to mention a solution to the problem.

Furthermore, neither Patent Literatures 2 nor 3 describes efficiency in use of visible light generated by a fluorescent material.

The present invention has been made in view of the problem, and it is an object of the present invention to provide an illumination device capable of enhancing light utilization efficiency.

Solution to Problem

In order to solve the foregoing problem, an illumination device in accordance with the present invention includes: a light emitting element; a reflecting mirror that reflects light emitted from the light emitting element so as to emit reflected light out of the device; and an optical member that reflects, toward a predetermined surface of the light emitting element, at least part of light that has not been directed toward the reflecting mirror, the light emitting element being provided substantially at a focal point of the reflecting mirror, and an optical axis of the optical member being inclined with respect to a normal line of the predetermined surface.

With the configuration, at least part of light, which has (i) been emitted from the light emitting element and (ii) not been directed toward the reflecting mirror, is reflected from the optical member to the predetermined surface of the light emitting element. Since the light emitting element is provided substantially at a focal point of the reflecting mirror, at least part of light that has been reflected toward the predetermined surface is emitted from substantially the focal point toward the reflecting mirror, and then the light distribution of such light is controlled by the reflecting mirror.

Therefore, it is possible to (i) effectively increase the ratio of the amount of light, whose light distribution is controlled by the reflecting mirror, to the amount of light emitted from the light emitting element and (ii) enhance light utilization efficiency of the illumination device.

Note that "substantially a focal point" means a point (i) falling within a range specified when a mathematically exact focal point is a basis and (ii) falling within a range specified in view of a predetermined allowable error for actual merchandises.

In order to solve the foregoing problem, an illumination device in accordance with the present invention includes: a light emitting element; a reflecting mirror that reflects light emitted from the light emitting element so as to emit reflected light out of the device; and an optical member that reflects, toward substantially a focal point of the reflecting mirror, at least part of light which has not been directed to the reflecting mirror, the light emitting element being provided substantially at the focal point, and having a surface which (i) faces a reflective surface of the reflecting mirror and (ii) is irradiated with light reflected from the optical member.

With the configuration, at least part of light, which has (i) been emitted from the light emitting element and (ii) not been directed toward the reflecting mirror, is reflected from the optical member to substantially a focal point of the reflecting mirror. The light emitting element (a) is provided substantially at the focal point and (b) has the surface (referred to as a counter surface) (I) facing the reflective surface of the reflecting mirror and (II) being irradiated with light reflected from the optical member. Since the counter surface of the light emitting element is irradiated with light reflected from the optical member, the light emitting element can efficiently reflect the light toward the reflecting mirror.

Therefore, it is possible to (i) effectively increase the ratio of the amount of light, whose light distribution is controlled by the reflecting mirror, to the amount of light emitted from the light emitting element and (ii) enhance light utilization efficiency of the illumination device.

Advantageous Effects of Invention

The present invention can (i) effectively increase the ratio of the amount of light, whose light distribution is controlled by a reflecting mirror, to the amount of light emitted from a light emitting element and (ii) enhance light utilization efficiency of an illumination device.

DESCRIPTION OF EMBODIMENTS

Embodiment 1

Figure 1:
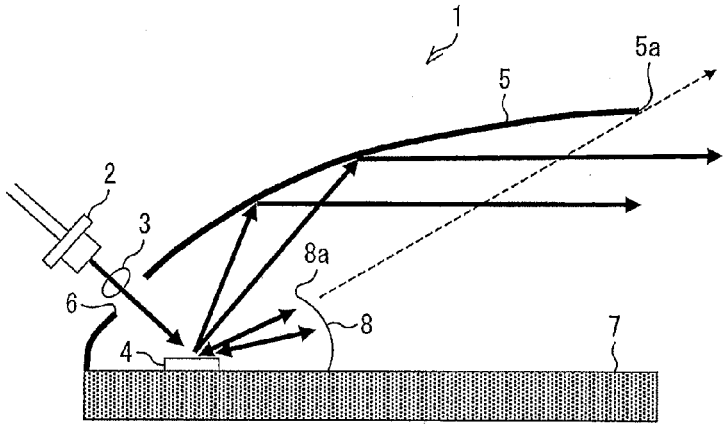
FIG. 1 is a cross-sectional view schematically illustrating a configuration of a headlight in accordance with Embodiment 1 of the present invention.
Figure 2:
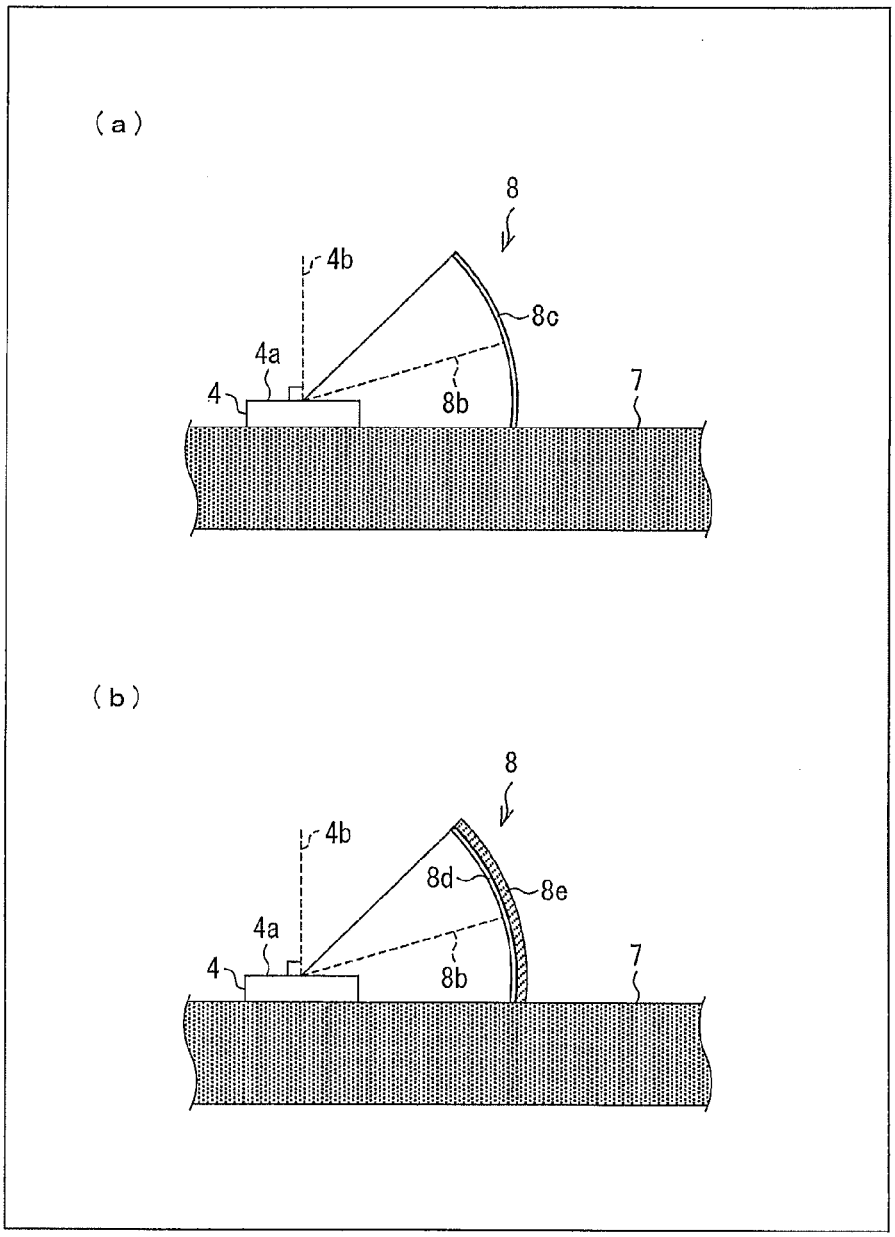
FIGS. 2(*a*) and (*b*) are cross-sectional views, FIG. 2(*a*) illustrating how a mini-mirror is provided in the headlight, and FIG. 2(*b*) illustrating another example of how a mini-mirror is provided in the headlight.
Figure 3:
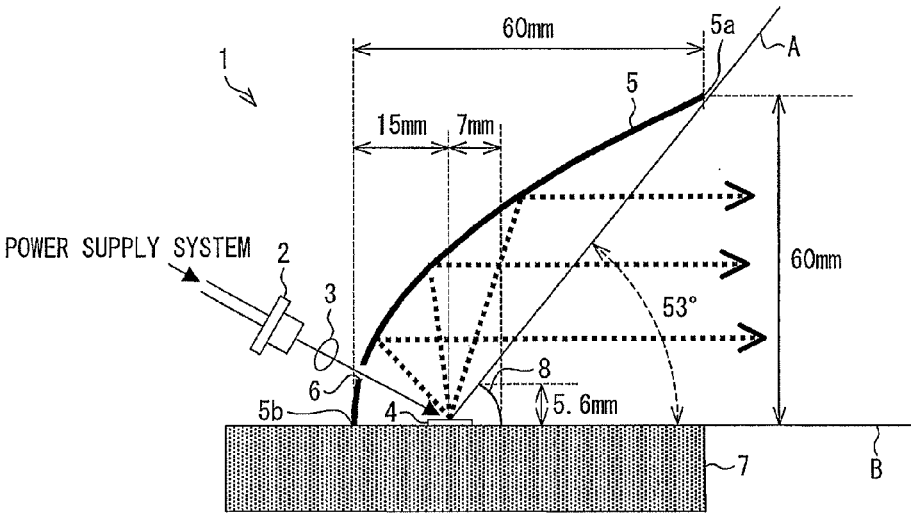
FIG. 3 is a cross-sectional view illustrating, in more detail, a structure of the headlight.

The following is a description of Embodiment 1 of the present invention with reference to FIGS. 1 through 3. In Embodiment 1, a headlight (vehicle headlight) will be described as an example of an illumination device of the present invention although an illumination device of the present invention is not limited to a headlight, but can be applied to other illumination devices.

Examples of an illumination device of the present invention can encompass a downlight. A downlight is an illumination device to be fixed to a ceiling of a structure such as a house or a vehicle. Other examples of the illumination device of the present invention to be achieved include (i) a headlight of a moving object, such as human being, ship, aircraft, submarine, or rocket, other than a vehicle and (ii) interior illumination equipment, such as desk lamp, other than a searchlight, a projector, and a downlight.

<Configuration of Headlight 1>

FIG. 1 is a cross-sectional view schematically illustrating a configuration of a headlight 1 in accordance with Embodiment 1 of the present invention. As shown in FIG. 1, the headlight 1 includes a laser element (excitation light source) 2, a lens 3, a fluorescent material light-emitting section (light emitting element) 4, a reflector (reflecting mirror) 5, a metal base (supporting member) 7, and a mini-mirror (optical member) 8.

The headlight 1 of Embodiment 1 uses, as illuminating light, fluorescence generated by irradiating, with a laser beam as excitation light, the fluorescent material light-emitting section containing a fluorescent material. Having said that, the headlight 1 can employ, as an excitation light source, an LED instead of the laser element 2.

(Laser Element 2)

The laser element 2 is a laser diode functioning as an excitation light source to emit excitation light. The number of the laser element 2 can be more than one. In the case where a plurality of laser elements 2 are provided, each of the plurality of laser elements 2 emits a laser beam as excitation light. Although a single laser element 2 can be employed, use of a plurality of laser elements 2 makes it easier to obtain high-output laser beams.

The laser element 2 can have, per chip, a single light emitting point or a plurality of light emitting points. The wavelength of a laser beam emitted from the laser element 2 is, for example, 405 nm (bluish-purple) or 450 nm (blue). However, the wavelength of the laser beam emitted from the laser element 2 is not limited to such wavelengths, and can therefore be suitably selected in accordance with a type of fluorescent material contained in the fluorescent material light-emitting section 4.

(Lens 3)

The lens 3 is for adjusting a range which is irradiated with a laser beam emitted from the laser element 2 so that the fluorescent material light-emitting section 4 is properly irradiated with the laser beam. The lenses 3 are provided for the respective laser elements 2.

(Fluorescent Material Light-Emitting Section 4)

The fluorescent material light-emitting section 4 (i) is a light emitting element that emits fluorescence (emitted light) upon reception of a laser beam emitted from the laser element 2 and (ii) contains a fluorescent material (fluorescent substance) that emits light upon reception of a laser beam. Herein, the phrase "fluorescent material light-emitting section 4 emits light" indicates that the light goes out of where the fluorescent material light-emitting section 4 is located. Note that light going out of the fluorescent material light-emitting section 4 can be (a) light generated inside the fluorescent material light-emitting section 4 or (b) externally entered light which has been reflected from a surface of the fluorescent material light-emitting section 4. In other words, the emitted light contains a laser beam that is (I) emitted from the laser element 2 and then (II) reflected from the surface of the fluorescent material light-emitting section 4 without being converted by the fluorescent material light-emitting section 4 into fluorescence.

Specifically, the fluorescent material light-emitting section 4 can be prepared by either dispersing a fluorescent material in a sealant or solidifying a fluorescent material. The fluorescent material light-emitting section 4 converts a laser beam into fluorescence, and therefore can be said to be a wavelength conversion element. Note that examples of the surface of the fluorescent material light-emitting section 4 can encompass one whose surface has been subjected to antireflection for preventing reflection of a laser beam.

The fluorescent material light-emitting section 4 is provided (i) on a surface (a surface facing a reflective surface of the reflector 5) of the metal base 7 and (ii) substantially at a focal point of the reflector 5. Therefore, an optical path of fluorescence emitted from the fluorescent material light-emitting section 4 is controlled by reflection of the fluorescence from the reflective surface of the reflector 5.

Additionally, as described later, the fluorescent material light-emitting section 4 receives, on its top surface facing the reflective surface of the reflector 5, fluorescence reflected from the mini-mirror 8. Part of the fluorescence is reflected from the surface of the fluorescent material light-emitting section 4, and is then directed toward the reflective surface of the reflector 5. Fluorescence other than the part is transmitted through the fluorescent material light-emitting section 4, is reflected from the surface of the metal base 7, and is then directed toward the reflective surface of the reflector 5. The light distribution of the fluorescence is controlled by the reflector 5, and the fluorescence is then emitted out as illuminating light.

In a case where a laser beam which has not been converted into fluorescence happens to be emitted from the fluorescent material light-emitting section 4, at least part of the laser beam is reflected from the mini-mirror 8 back toward the fluorescent material light-emitting section 4, and is then converted into fluorescence by the fluorescent material contained in the fluorescent material light-emitting section 4.

(Composition of Fluorescent Material Light-Emitting Section 4)

The fluorescent material light-emitting section 4 is not limited in its composition. Examples of a fluorescent material for the fluorescent material light-emitting section 4 encompass a YAG fluorescent material, an oxynitride fluorescent material (e.g. a sialon fluorescent material), a III-V compound semiconductor nanoparticle fluorescent material (e.g. indium phosphide: InP), and a nitride fluorescent material. In a case where an excitation light source with high output (and/or high optical density) such as a laser element is used, a fluorescent material having high heat resistance to a laser beam is the most suitable.

By law, the color of illuminating light of a headlight is required to be white having chromaticity within a prescribed range. Therefore, the fluorescent material light-emitting section 4 contains a fluorescent material that is selected so as to emit white illuminating light.

For example, white light can be obtained by irradiating, with a laser beam of 405 nm, a fluorescent material light-emitting section 4 containing a blue fluorescent material, a green fluorescent material, and a red fluorescent material. Alternatively, white light can be obtained by irradiating, with a laser beam of 450 nm (blue) (or what is known as a near-blue laser beam having a peak wavelength in the range of 440 nm to 490 nm), a fluorescent material light-emitting section 4 containing a yellow fluorescent material (or a green fluorescent material and a red fluorescent material).

Nevertheless, illuminating light does not necessarily need to have a white color in a case where the present invention is employed as an illumination device other than a vehicle headlight.

Examples of a sealant of the fluorescent material light-emitting section 4 include resin materials such as glass materials (inorganic glass and organic-inorganic hybrid glass) and silicon resin. The sealant is preferably a highly transparent material. In a case where a laser beam has high output, the sealant is preferably a material having high heat resistance.

The fluorescent material light-emitting section 4 can be prepared with the use of electrophoresis by depositing, on a metal substrate serving as electrodes, fluorescent material particles in layers. In so doing, a binder can be used so that fluorescent material particles adhere to each other. For example, such a binder can be obtained by adding, to ethanol, (i) TEOS (tetraethoxysilane) or TEMOS (tetramethoxysilane), (ii) water, and (iii) acid (e.g. concentrated hydrochloric acid), and then being subjected to hydrolysis. Through dehydration and calcination, the binder ultimately becomes silica.

(Form and Size of Fluorescent Material Light-Emitting Section 4)

The form of the fluorescent material light-emitting section 4 is not particularly limited, and can be cuboidal or cylindrical. The fluorescent material light-emitting section 4 is also not particularly limited in its size.

Also, the fluorescent material light-emitting section 4 is preferably thin. "The fluorescent material light-emitting section is thin" means that a side surface(s) of the fluorescent material light-emitting section 4 is sufficiently smaller in size than the top surface, and that the majority of fluorescence is emitted upward (that is, toward the reflective surface of the reflector 5).

(Reflector 5)

The reflector 5 reflects fluorescence emitted from the fluorescent material light-emitting section 4, and forms light beams (illuminating light) that travel within a predetermined solid angle. In other words, the reflector 5 reflects fluorescence emitted from the fluorescent material light-emitting section 4, and emits out the fluorescence. Examples of the reflector 5 encompass a member with a metal film formed thereon or a member made from metal.

Part of the reflective surface of the reflector 5 is at least part of a partial curved surface obtained through (i) forming a curved surface (parabolic curved surface) by rotating a parabola around a symmetry axis (serving as a rotation axis)

of the parabola and then (ii) cutting the parabolic curved surface along a flat surface in which the rotation axis is contained.

Having said that, the reflector 5 is not limited to a mirror having a parabolic shape. Therefore, the reflector 5 can be an elliptical mirror or a spherical mirror. Specifically, part of the reflective surface of the reflector 5 can be at least part of a partial curved surface obtained through (i) forming a curved surface by rotating a circle or an ellipse around a symmetry axis (serving as a rotation axis) of the circle or the ellipse and then (ii) cutting the curved surface along a flat surface in which the rotation axis is contained.

Such a reflector 5 is provided so as to cover the top surface of the fluorescent material light-emitting section 4. The top surface of the fluorescent material light-emitting section 4 is a surface having a part facing the reflective surface of the reflector 5. More specifically, the top surface (predetermined surface) of the fluorescent material light-emitting section 4 is a surface having a plurality of normal lines at least some of which intersect with the reflective surface of the reflector 5.

The laser element 2 is provided outside the reflector 5. The reflector 5 has a window 6 that transmits or lets a laser beam therethrough. The window 6 can be an opening or can be a member having a transparent part capable of transmitting a laser beam therethrough. For example, it is possible to provide, as a window 6, a transparent member having a filter for (i) transmitting a laser beam therethrough and (ii) reflecting fluorescence emitted from the fluorescent material light-emitting section 4. With this configuration, it is possible to prevent, from escaping through the window 6, fluorescence emitted from the fluorescent material light-emitting section 4.

In the case where the plurality of laser elements 2 are to be provided, the plurality of laser elements 2 can share a single window 6, or there can be provided a plurality of windows 6 for the respective laser elements 2.

(Metal Base 7)

The metal base 7 has a surface (hereinafter, referred to as a counter surface) facing the reflective surface of the reflector 5, and serves as a supporting member that supports, via the counter surface, the fluorescent material light-emitting section 4. The mini-mirror 8 is provided on the counter surface of the metal base 7. That is, the fluorescent material light-emitting section 4 and the mini-mirror 8 are provided on the same substrate. This makes it easy to steadily and exactly provide the mini-mirror 8 with respect to the fluorescent material light-emitting section 4.

The metal base 7 is made of metal (such as copper, iron, or aluminum) and is thus highly thermally conductive and capable of efficiently dissipating heat generated by the fluorescent material light-emitting section 4.

It should be noted that a member to support the fluorescent material light-emitting section 4 is not limited to a metal one, and can therefore be a member containing, other than metal, a highly thermally conductive material (such as glass or sapphire). It is preferable that the counter surface of the metal base 7 functions also as a reflective surface. Since the counter surface functions also as a reflective surface, it is possible for a laser beam, which has entered the top surface of the fluorescent material light-emitting section 4 and has been converted into fluorescence, to be reflected from the reflective surface so as to be directed toward the reflector 5.

(Mini-Mirror 8)

The mini-mirror 8 is preferably a mirror having a concave spherical surface. At least part of emitted light (fluorescence and/or a laser beam), which is (i) emitted from the fluorescent material light-emitting section 4 and (ii) not directed toward the reflector 5, is reflected from the mini-mirror 8 toward the top surface of the fluorescent material light-emitting section 4 provided substantially at a focal point of the reflector 5. Then, at least one component (fluorescence) of the light (fluorescence and/or a laser beam) reflected back toward the focal point is directed toward the reflector 5.

A center of curvature of the mini-mirror 8 is substantially identical to a focal point of the reflector 5. Therefore, light reflected from the mini-mirror 8 is converged onto substantially a focal point of the reflector 5.

Note that "substantially a focal point" means a point (i) falling within a range specified when a mathematically exact focal point is a basis and (ii) falling within a range specified in view of a predetermined allowable error for actual merchandises.

By employing, as the mini-mirror 8, a mirror having a concave spherical surface, it is made easy to converge, onto a focal point of the reflector 5, light emitted from the fluorescent material light-emitting section 4.

Note that the mini-mirror 8 is fixed on the surface (counter surface) of the metal base 7. The method for fixing the mini-mirror 8 on the surface is not limited to a particular one. For example, the mini-mirror 8 can be fixed on the surface via a protrusion provided so that the protrusion extends from an edge of the mini-mirror 8.

Also note that light reflected from the mini-mirror 8 does not need to be converged onto an exact focal point of the reflector 5. The light can be converged onto or reflected back to substantially the focal point.

FIG. 2(*a*) and FIG. 2(*b*) are cross-sectional views each illustrating how the mini-mirror 8 is provided. As shown in FIG. 2(*a*) and FIG. 2(*b*), an optical axis 8*b* of the mini-mirror 8 is inclined with respect to a normal line 4*b* of a top surface 4*a* of the fluorescent material light-emitting section 4. It follows that the optical axis 8*b* of the mini-mirror 8 is not parallel to the normal line 4*b*. It should be noted that an optical axis of the mini-mirror 8 is a central axis of a light beam to be reflected from the mini-mirror 8. In other words, the optical axis is a virtual line which is a corridor of a central light beam among all light beams reflected from the mini-mirror 8. The optical axis of the mini-mirror 8 can also be described as a straight line connecting a center (peak) of an inner wall of the mini-mirror 8 and the center of curvature.

Since the optical axis 8*b* of the mini-mirror 8 is inclined with respect to the normal line 4*b* of the top surface 4*a* of the fluorescent material light-emitting section 4, light reflected from the mini-mirror 8 is prevented, after the top surface 4*a* is irradiated with the light reflected from the mini-mirror 8, from being further reflected from the top surface 4*a* and being redirected toward the mini-mirror 8. That is, with this configuration, it is possible to prevent light from being repeatedly reflected from the mini-mirror 8 to the top surface 4*a* of the fluorescent material light-emitting section 4 and vice versa.

It should be noted that the top surface of the fluorescent material light-emitting section 4 is also a surface having a part facing the reflective surface of the reflector 5. More specifically, the top surface is a surface having a plurality of normal lines at least some of which intersect with the reflective surface of the reflector 5. That is, not necessarily the entire top surface of the fluorescent material light-emitting section 4 needs to face the reflective surface of the reflector 5, provided that part of the top surface faces the reflective surface of the reflector 5.

Also, the top surface of the fluorescent material light-emitting section 4 does not necessarily need to be irradiated with the entire part of light reflected from the mini-mirror 8, provided that the top surface is irradiated with at least some of the light.

(Material for Mini-Mirror 8)

A material for the mini-mirror 8 can be the same material for the reflector 5, and is not limited to a particular one. For example, the mini-mirror 8 can be made of aluminum or can be a resin coated with a highly reflective metal such as aluminum or silver.

Note that a laser beam reflecting layer 8*c* for reflecting a laser beam can be further provided on a reflective surface of the mini-mirror 8. For example, the laser beam reflecting layer 8*c* can be realized by (i) the only layer constituting the mini-mirror 8 as shown in FIG. 2(*a*) or (ii) one of a plurality of layers of which the mini-mirror 8 is made up. The laser beam reflecting layer 8*c* can be a layer that transmits fluorescence therethrough or a layer that reflects fluorescence. In the case where the laser beam reflecting layer 8*c* transmits fluorescence therethrough, the laser beam reflecting layer 8*c* transmits, therethrough, fluorescence (i) reflected from a part of the reflective surface of the reflector 5 in the vicinity of a peak of the reflector 5 and (ii) whose light distribution is controlled. This allows an improvement in light utilization efficiency of an illumination device in which the laser beam reflecting layer 8*c* is employed. Additionally, the laser beam reflecting layer 8*c* can be formed on a base layer having a concave spherical surface.

Alternatively, a laser beam absorbing layer 8*d* for absorbing a laser beam can be provided on the mini-mirror 8. The laser beam absorbing layer 8*d* can be a layer that transmits fluorescence therethrough or a layer that reflects fluorescence.

In the case where the laser beam absorbing layer 8*d* transmits fluorescence therethrough, it is preferable, as shown in FIG. 2(*b*), that a reflective layer 8*e* for reflecting fluorescence is further provided so as to be farther out from the laser beam absorbing layer 8*d* as a basis (so as to be farther away from the fluorescent material light-emitting section 4). The reflective layer 8 is, for example, a layer (coat) made of a material such as silver or aluminum.

It is possible to use, for example, an ultraviolet rays absorbing filter (ITY series) manufactured by Isuzu Glass Co. Ltd. as a layer that transmits visible light (including fluorescence) therethrough and absorbs ultraviolet light. In a case where a laser beam having a wavelength falling within an ultraviolet region is used, it is possible to achieve a mini-mirror 8, which reflects fluorescence and absorbs a laser, by providing the ultraviolet absorbing filer on a front side of a reflective surface of a mirror having a concave spherical surface.

Since the laser beam absorbing layer 8*d* absorbs a laser beam whereas reflects fluorescence, it is made possible to enhance efficiency in use of fluorescence as well as reduce the possibility that a laser beam leaks out of the headlight 1. This allows an improvement in the safety of the headlight 1.

(Positioning and Size of Mini-Mirror 8)

FIG. 3 is a cross-sectional view illustrating the structure of the headlight 1 in more detail. Although the structure of the headlight 1 is described here with specific numerical values, the numerical values described in FIG. 3 are illustrative only, and the present invention are therefore not limited to the numerical values.

The mini-mirror 8 intersects with (i) a straight line (half line A with the focal point serving as a point of origin in FIG. 3) through substantially a focal point of the reflector 5 and an edge of an opening 5*a* of the reflector 5 and (ii) a straight line (half line B with a peak 5*b* serving as a point of origin in FIG. 3) through substantially the focal point and the peak 5*b* of the reflector 5. With the configuration, it is possible to reflect, back toward the fluorescent material light-emitting section 4, most of light which has (a) been emitted from the fluorescent material light-emitting section 4 and (b) has not been directed toward the reflector 5.

Specifically, in a cross section shown in FIG. 3, emitted light, which is emitted from the fluorescent material light-emitting section 4 and is not directed toward the reflector 5, passes through a two dimensional region located within an angle of 53° between half line A and half line B. Meanwhile, emitted light not directed toward the reflector 5 passes through a three dimensional space defined by (i) a curved surface obtained by rotating the half line A around the half line B serving as a rotation axis and (ii) the counter surface of the metal base 7. Since the mini-mirror 8 covers such a three dimensional space, the mini-mirror 8 can reflect most of the light not directed toward the reflector 5 and then redirect it back toward the fluorescent material light-emitting section 4.

Note that it is possible to alter, as desired, the size of the mini-mirror 8, provided that the mini-mirror 8 intersects the half line A and the half line B. It is possible to downsize the mini-mirror 8 as the mini-mirror 8 is drawn closer to the fluorescent material light-emitting section 4. In FIG. 3, the mini-mirror 8 is 5.6 mm in height (the distance from the metal base 7 to a reflector-5-facing end section of the mini-mirror 8). The reflector 5 is 60 mm in height (the radius of a semicircle defined by an opening end of the reflector 5). The height of the mini-mirror 8 is thus lower than 10% of the height of the reflector 5.

If the mini-mirror 8 is large, then the mini-mirror 8 might possibly reflect fluorescence whose light distribution has been controlled by the reflector 5. Thus, the mini-mirror 8 is preferably as small as possible. Accordingly, it is preferable that the mini-mirror 8 is provided as closely to the fluorescent material light-emitting section 4 as possible.

In concrete terms, it is preferable that a distance between a location where the mini-mirror 8 is provided on the metal base 7 and a focal point of the reflector 5 is shorter than a minimum distance between the focal point and the reflector 5. FIG. 3 shows that, on the surface of the metal base 7, the distance between the mini-mirror 8 and the focal point of the reflector 5 is 7 mm, and the distance between the focal point and the reflector 5 is 15 mm.

(Working Effects of Headlight 1)

According to the headlight 1, emitted light (fluorescence and/or a laser beam), which is (i) emitted from the fluorescent material light-emitting section 4 and (ii) not directed toward the reflective surface of the reflector 5, is reflected from the mini-mirror 8 toward substantially a focal point of the reflector 5 and is then emitted again from substantially the focal point. This causes at least part of the emitted light to be directed toward the reflective surface of the reflector 5. Therefore, it is possible to (a) effectively increase the ratio of the amount of light whose light distribution is controlled by the reflector 5 to that of light emitted from the fluorescent material light-emitting section 4 and therefore (b) enhance efficiency in use of emitted light emitted from the fluorescent material light-emitting section 4.

In addition, since the optical axis 8*b* of the mini-mirror 8 is inclined with respect to the normal line 4*b* of the top surface 4*a* of the fluorescent material light-emitting section 4, it is possible to prevent light from being repeatedly reflected from the mini-mirror 8 to the top surface 4*a* of the fluorescent material light-emitting section 4 and vice versa. It is thus possible to prevent the light from being attenuated. This ultimately allows the light utilization efficiency to be even more effectively enhanced.

In a case where light emitted from the fluorescent material light-emitting section 4 contains a laser beam which has not been converted into fluorescence, at least part of the laser beam is (i) absorbed by the laser beam absorbing layer 8*d* or (ii) reflected back from the mini-mirror 8 toward the fluorescent material light-emitting section 4 so as to be converted into fluorescence by a fluorescent material contained in the fluorescent material light-emitting section 4.

Since it is possible to reduce a possibility that light is leaked out of the headlight 1, it is possible to improve the safety of the headlight 1.

According to the headlight 1, the mini-mirror 8 is provided in the vicinity of the fluorescent material light-emitting section 4 and on a side closer to the opening of the reflector 5. This (i) makes it hard for the fluorescent material light-emitting section 4 to be seen from outside and therefore (ii) can improve the safety of the headlight 1.

By providing the mini-mirror 8 as shown in FIG. 3, it is possible for the mini-mirror 8 to be made even more unlikely to be seen from outside. This allows a further improvement in the safety of the headlight 1.

Embodiment 2

Figure 4:
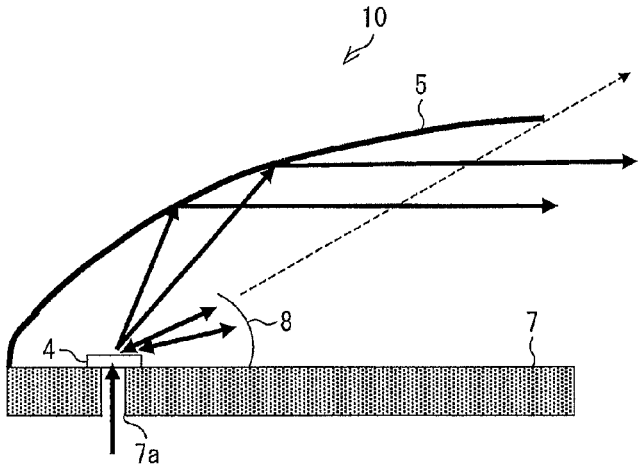
FIG. 4 is a cross-sectional view illustrating a configuration of a headlight in accordance with Embodiment 2 of the present invention.
Figure 5:
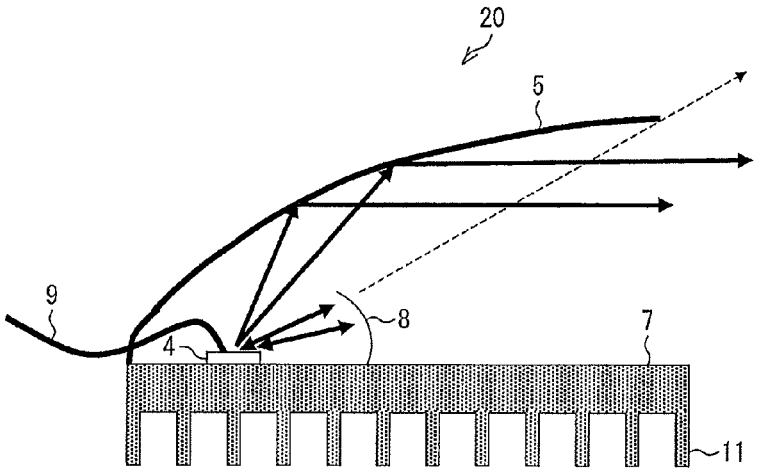
FIG. 5 is a cross-sectional view illustrating a configuration of a headlight in accordance with Embodiment 2 of the present invention.

The following is a description of Embodiment 2 of the present invention with reference to FIG. 4 and FIG. 5. It should be noted that, in Embodiment 2, members whose functions are the same as those of Embodiment 1 are given the same reference numerals/signs accordingly, and their description will be omitted. The same applies to Embodiments 3 through 6 (later described).

According to the headlight 1 of Embodiment 1, the top surface 4*a* of the fluorescent material light-emitting section 4 is irradiated with the laser beam emitted from the laser element 2, via the window 6 of the reflector 5. However, the present invention is not limited to this. The top surface 4*a* can be irradiated with a laser beam based on another method.

FIG. 4 is a cross-sectional view illustrating a configuration of a headlight 10 in accordance with Embodiment 2 of the present invention. According to the headlight 10, (i) a metal base 7 has an opening 7*a* and (ii) the fluorescent material light-emitting section 4 is irradiated with a laser beam which enters, via the opening 7*a*, from a bottom surface (a surface opposite to a top surface 4*a*) of the fluorescent material light-emitting section 4 (see FIG. 4).

This makes it unnecessary for a reflector 5 to have a window 6, and allows an actual increase in the area of a reflective surface of the reflector 5. This ultimately allows an increase in the amount of fluorescence whose light distribution can be controlled by the reflector 5.

The fluorescent material light-emitting section 4 can be larger than the opening 7*a* of the metal base 7 so as to cover the opening 7*a* as shown in FIG. 4. Alternatively, a fluorescent material light-emitting section 4 can have substantially the same size as that of the opening 7*a* so as be fitted in the opening 7*a*.

FIG. 5 is a cross-sectional view illustrating a configuration of a headlight 20 in accordance with Embodiment 2 of the present invention. As shown in FIG. 5, a fluorescent material light-emitting section 4 can be irradiated, via a light guiding means such as an optical fiber 9, with a laser beam emitted from a laser element 2. By using an optical fiber as a light guiding member, it is made possible to guide light from a location that causes light distribution control of the reflector 5 to be less affected. This allows an increase in the amount of light whose light distribution can be controlled.

Note that it is possible to use, in stead of an optical fiber, a light guiding member having a circular cone frustum shape or a pyramid frustum shape. Such an alternative light guiding member has (i) a light entrance surface for receiving a laser beam from the laser element 2 and (ii) a light exit surface for emitting a laser beam, received through the light entrance surface, with which laser beam the fluorescent material light-emitting section 4 is irradiated. By keeping the area of the light exit surface smaller than the area of the light entrance surface, a laser beam which has entered the light entrance surface makes a forward move while being reflected from a side surface of a light guiding member. This causes the laser beam to be converged and then emitted from the light exit surface.

In addition, a heat exchange mechanism such as a fin 11 for heat dissipation can be provided on a back side of the metal base 7. The fin 11 has a plurality of heat dissipating plates, and intends to enhance heat dissipation efficiency by increasing an area exposed to air. The mechanism for dissipating heat of the metal base 7 is not limited to a specific one, provided that it has a heat dissipation or cooling function. The mechanism can be a heat pipe or of a water-cooled type or of an air-cooled type.

Such a heat exchange mechanism causes heat to be efficiently dissipated. The heat is generated while the fluorescent material light-emitting section 4 is being irradiated with a laser beam. It is therefore possible to prevent hypofunction of the fluorescent material light-emitting section 4 due to the heat thus generated.

Embodiment 3

Figure 6:
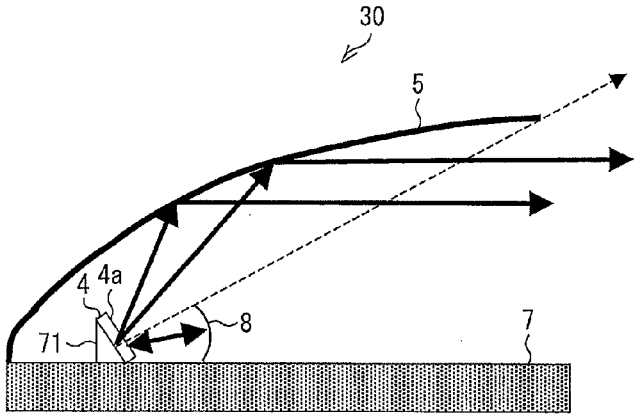
FIG. 6 is a cross-sectional view illustrating a configuration of a headlight in accordance with Embodiment 3 of the present invention.

The following is a description of Embodiment 3 of the present invention with reference to FIG. 6. FIG. 6 is a cross-sectional view illustrating a configuration of a headlight 30 in accordance with Embodiment 3 of the present invention. Note that members such as a laser element 2 are, for convenience, not illustrated in FIG. 6.

In the headlight 30, a slope 71 is provided on a surface of a metal base 7. The slope 71 functions as an angle maintaining section that maintains, at a predetermined angle, an angle between a top surface 4*a* of a fluorescent material light-emitting section 4 and the surface of the metal base 7.

According to the example shown in FIG. 6, some normal lines of the top surface 4*a* of the fluorescent material light-emitting section 4 intersect with a reflective surface of a reflector 5. It follows that part of the top surface 4*a* does not face the reflective surface of the reflector 5, but faces a mini-mirror 8. The fluorescent material light-emitting section 4 is in FIG. 6 inclined such that the normal lines extend toward an opening of the reflector 5. Embodiment 3 is not limited to this. For example, the fluorescent material light-emitting section 4 can be inclined such that normal lines extend toward a peak of the reflector 5.

It is a prerequisite for the present invention that a surface, at least part of which faces the reflective surface of the reflector 5, be irradiated with light reflected from the mini-mirror 8. As such, the configuration shown in FIG. 6 is encompassed in the technical scope of the present invention.

Embodiment 4

Figure 7:
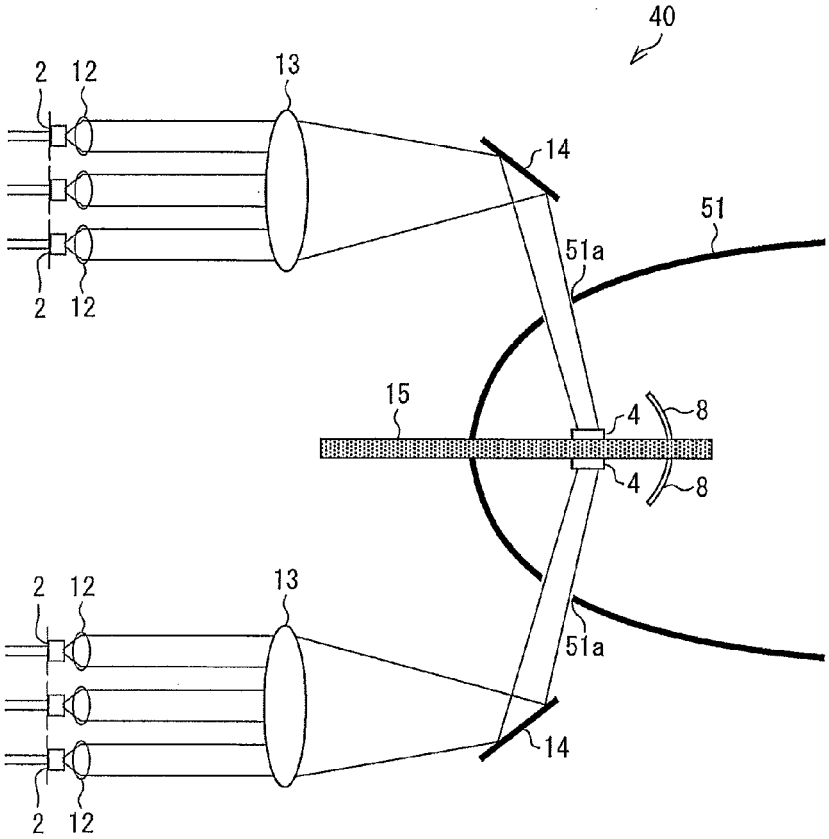
FIG. 7 is a cross-sectional view illustrating a configuration of a headlight in accordance with Embodiment 4 of the present invention.

The following is a description of Embodiment 4 of the present invention with reference to FIG. 7. An illumination device of the present invention can be a reflector having an opening in a closed-circle shape or part of the closed-circle shape. A concrete example of such a configuration will be discussed below.

FIG. 7 is a cross-sectional view illustrating a configuration of the headlight 40 in accordance with Embodiment 4 of the present invention. As shown in FIG. 7, the headlight 40 includes a plurality of sets of a laser element 2 and a lens 12, light converging lenses 13, reflecting mirrors 14, fluorescent material light-emitting sections 4, mini-mirrors 8, a reflector (reflecting mirror) 51, and a metal plate (holder) 15.

The reflector 51 has its paraboloid of revolution serving as a reflective surface, and has an opening in a closed-circle shape. Specifically, the reflective surface of the reflector 51 has a part which is at least part of a curved surface obtained by rotating a parabola around an axis of symmetry of the parabola, which axis serves as a rotation axis.

The metal plate 15 is a copper plate coated with silver. The metal plate 15 passes through around a peak of the reflector 51 and extends inward so as to be parallel to a central axis of the reflector 51. The fluorescent material light-emitting sections 4 are provided on respective front and rear surfaces of the metal plate 15, and the fluorescent material light-emitting sections 4 are irradiated with respective laser beams. The fluorescent material light-emitting sections 4 are provided substantially at a focal point of the reflector 51.

Each laser beam emitted from a corresponding one of the laser elements 2 is collimated by a corresponding one of the lenses 12, is converged, by a corresponding one of the light converging lenses 13, so as to have the size of a top surface of a corresponding one of the fluorescent material light-emitting sections 4, and is then reflected from a corresponding one of the reflecting mirrors 14 toward the corresponding one of the fluorescent material light-emitting sections 4 through a window 51*a* of the reflector 51.

There are thus provided two sets of the laser elements 2, the lenses 12, the light converging lens 13, and the reflecting mirror 14 so that the two fluorescent material light-emitting sections 4 are irradiated with the respective laser beams. There are further provided, on the reflector 51, the two windows 51*a* each of which has a function similar to the foregoing window 6.

The metal plate 15 functions to (i) support the fluorescent material light-emitting sections 4 and the mini-mirrors 8 and (ii) dissipate heat generated by the fluorescent material light-emitting sections 4. Note that the metal plate 15 can have, at an end part on its other side, a heat exchange mechanism such as fins for heat dissipation.

The headlight 40 is similar to the headlight 1 in terms of (i) how to provide the fluorescent material light-emitting section 4 and the mini-mirror 8 and (ii) functions and effects of the mini-mirror 8.

Embodiment 5

Figure 8:
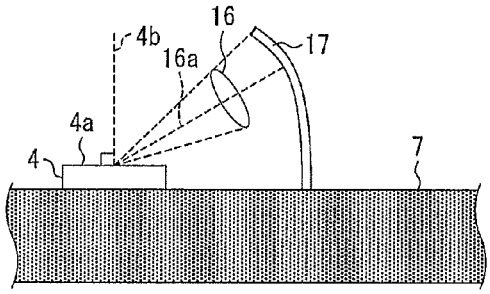
FIG. 8 is a cross-sectional view illustrating an example modification of a mini-mirror included in the headlight.

FIG. 8 is a cross-sectional view illustrating an example modification of the mini-mirror 8. A mini-mirror (optical member) included in an illumination device of the present invention is not limited to a mirror having a spherical surface. The mini-mirror can be a combination of a plurality of optical members. In the example shown in FIG. 8, an optical member, which is an equivalent of the mini-mirror 8, is made up of a combination of a light converging lens (optical member) 16 and a reflecting mirror (optical member) 17.

The reflecting mirror 17 is a mirror that reflects, toward the fluorescent material light-emitting section 4, light that has been emitted from the fluorescent material light-emitting section 4. Examples of the reflecting mirror 17 can encompass a parabolic mirror, an elliptically shaped mirror, and a flat-surface mirror. The shape of the reflecting mirror 17 can be appropriately selected in view of a relation with a light converging lens 16.

The light converging lens 16 converges at least part of light reflected from the reflecting mirror 17 onto a top surface 4*a* of the fluorescent material light-emitting section 4. To be more specific, an optical axis 16*a* of the light converging lens 16 meets substantially a focal point of the a reflector 5, and therefore at least part of light reflected from the reflecting mirror 17 is converged onto substantially the focal point.

It is possible to employ a configuration in which light emitted from the fluorescent material light-emitting section 4 is thus reflected back toward the fluorescent material light-emitting section 4, with the use of a plurality of optical members.

Embodiment 6

Figure 9:
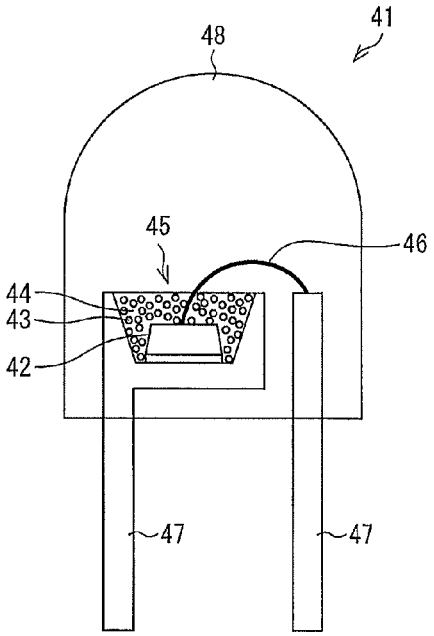
FIG. 9 is a cross-sectional view illustrating a configuration of a headlight in accordance with Embodiment 6 of the present invention.
Figure 10:
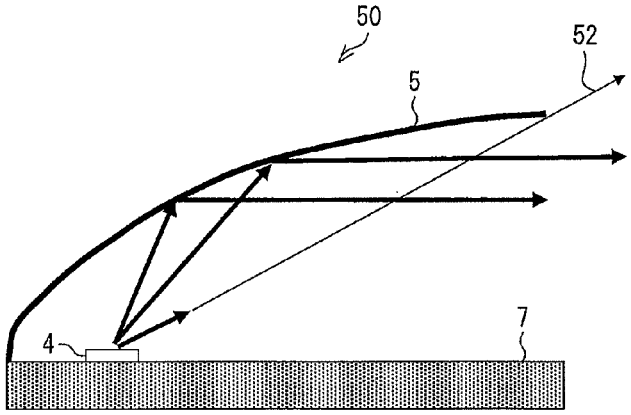
FIG. 10 is a view illustrating a problem for which the present invention has been made as a solution.

An illumination device of the present invention can include, in stead of a combination of a laser element and a fluorescent material light-emitting section, an LED including (i) an LED chip serving as an excitation light source and (ii) a fluorescent material. FIG. 9 is a cross-sectional view illustrating a configuration of an LED 41 serving as a light source of an illumination device of the present invention.

As shown in FIG. 9, the LED 41 includes an LED chip 42, and fluorescent material particles 43 are provided around the LED chip 42. The LED chip 42 and the fluorescent material particles 43 are sealed with a sealant 44. The fluorescent material particles 43 and the sealant 44 can be made of materials similar to the respective materials of which a fluorescent material and a sealant together constituting the fluorescent material light-emitting section 4 are made. Such materials are not limited to particular ones.

The LED chip 42 is connected with a thin metal wire 46 and lead wires 47, via which electric power is externally supplied to the LED chip 42.

For convenience, the LED chip 42, the fluorescent material particles 43, and the sealant 44 are regarded as a single component, and are, hereinafter, referred to as a light emitting section 45. The light emitting section 45 is provided substantially at a focal point of a reflector 5 as with the fluorescent material light-emitting section 4. Note that the light emitting section 45, the thin metal wire 46, and the lead wires 47 are fixed by a transparent resin 48.

The fluorescent material particles 43 generates fluorescence upon irradiation with excitation light emitted from the LED chip 42, and the fluorescence is then emitted from the light emitting section 45. At least part of emitted light (fluorescence and/or excitation light), which is (i) emitted from the light emitting section 45 and (ii) not directed toward the reflector 5, is reflected back toward substantially a focal point by a mini-mirror 8, and is then emitted again from the substantially the focal point. This causes the light to be directed toward the reflector 5.

In a case where light emitted from the light emitting section 45 contains excitation light which has not been converted into fluorescence, the excitation light is (i) reflected back toward substantially a focal point by the mini-mirror 8, (ii) converted into fluorescence by the fluorescent material particles 43 contained in the light emitting section 45 positioned at the approximate focal point, and then (iii) emitted out.

Therefore, light utilization efficiency can be enhanced also in the configuration including the LED 41.

(Another Modification)

In a case where the present invention is employed as an illumination source for a projector, the present invention can be configured such that (i) an elliptical mirror (a mirror having an elliptical surface) is used as a reflector 5, (ii) a fluorescent material light-emitting section 4 is provided at a first focal point of the elliptical mirror, and (iii) a rod lens is provided at a second focal point of the elliptical mirror. More specifically, the rod lens is provided so that its one end surface which light enters is located at the second focal point of the elliptical mirror. A mini-mirror 8 is provided so as to reflect, toward the fluorescent material light-emitting section 4, at least part of emitted light which is not directed to the elliptical mirror. How to provide the fluorescent material light-emitting section 4 and the mini-mirror 8 is similar to that of the other Embodiments.

Fluorescence reflected from the elliptical mirror (i) enters the rod lens through the one end surface which the light enters, (ii) is guided through the rod lens, and (iii) is then emitted from a light exit surface which is the other end surface of the rod lens.

The rod lens functions as an optical indirector. The rod lens can reduce non-uniformity in illumination intensity, color heterogeneity, and generation of flickering, by mixing angular components of the beam of light together. The form of the rod lens can be a circular cylinder or a rectangular column, and can be selected in accordance with a target shape of a spot of illuminating light.

The present invention is not limited to the description of the Embodiments, but can be altered by a person skilled in the art within the scope of the claims. An embodiment derived from a proper combination of technical means disclosed in different embodiments is also encompassed in the technical scope of the present invention.

[Another Presentation of the Present Invention]

The present invention can also be presented as follows.

Specifically, the present invention is preferably configured such that a predetermined surface is a surface having a part facing a reflective surface of a reflecting mirror.

With the configuration, the surface of the light emitting element which surface has a part facing the reflective surface of the reflecting mirror is irradiated with light reflected from an optical member. In other words, not necessarily the entire predetermined surface needs to face the reflective surface of the reflecting mirror, provided that at least part of the predetermined surface faces the reflective surface of the reflecting mirror.

With the configuration, it is possible to increase a possibility that light reflected from the optical member is then reflected by the predetermined surface of the light emitting element so as to be directed toward the reflecting mirror.

Additionally, the present invention is preferably configured such that at least part of the light, which is emitted from the light emitting element and is then reflected back from the optical member toward substantially the focal point, is directed toward the reflective mirror.

With the configuration, it is possible to (i) cause at least part (e.g. light to be used as illuminating light such as fluorescence) of light, which is not directed toward the reflecting mirror, to be directed toward the reflecting mirror and therefore (ii) enhance efficiency in use of at least part of the light.

Furthermore, the present invention preferably further includes: an excitation light source for emitting excitation light, the light emitting element containing a fluorescent material that emits fluorescence upon reception of the excitation light, excitation light, which has not been converted into fluorescence, being reflected back, from the optical member, toward the light emitting element, and being then converted by the fluorescent material into fluorescence.

With the configuration, since excitation light which has not been converted into fluorescence is reflected back from the optical member, the excitation light can be then converted into fluorescence. This allows efficiency in conversion of excitation light into fluorescence to be enhanced.

Furthermore, the present invention can be configured such that the excitation light is a laser beam.

Use of a laser beam as excitation light achieves a light source with high luminance. A laser beam which has not been converted into fluorescence is reflected back from the optical member, and is then converted into fluorescence. This makes it possible to reduce a possibility that a laser beam, which is harmful to a human eye, leaks out of the illumination device.

In addition, the present invention is preferably configured such that the optical member has a layer that reflects the fluorescence and absorbs the laser beam.

With the configuration, it is possible to (i) cause the optical member to absorb a laser beam which has not been converted into fluorescence and therefore (ii) reduce a possibility that a laser beam leaks out of the illumination device. It is also possible to enhance efficiency in use of fluorescence by reflecting, with the use of the optical member, fluorescence back toward substantially a focal point.

Furthermore, the present invention is preferably configured such that the optical member has a layer that transmits the fluorescence therethrough and reflects the laser beam.

With the configuration, it is possible to (i) cause the optical member to reflect, back toward the light emitting element containing a fluorescent material, a laser beam which has not been converted into fluorescence and therefore (ii) enhance efficiency in use of a laser beam.

Moreover, the present invention is preferably configured such that the optical member intersects with (i) a straight line through substantially the focal point and an edge of an opening of the reflecting mirror and (ii) a straight line through a peak of the reflecting mirror and substantially the focal point.

With the configuration, it is possible to (i) reflect back, toward the light emitting element, most of emitted light which has (a) been emitted from the light emitting element and (b) not been directed toward the reflecting mirror and therefore (ii) remarkably enhance light utilization efficiency.

Besides, the present invention is preferably configured such that a distance between the optical member and substantially the focal point is shorter than a minimum distance between substantially the focal point and the reflecting mirror.

The optical member is preferably as small as possible because, if the optical member was large, the optical member could block light whose light distribution has been controlled by the reflecting mirror. Therefore, the optical member is preferably provided as closely to the light emitting element as possible. For example, in concrete terms, a distance between the optical member and a focal point of the reflecting mirror is preferably shorter than a distance between the focal point and the reflecting mirror.

Furthermore, the present invention is preferably configured such that the optical member has a concave spherical surface.

Since a mirror having a concave spherical surface is used as at least part of the optical member, it is easy to converge, onto a focal point of the reflecting mirror, light emitted from the light emitting element.

Additionally, the present invention is preferably configured such that: the reflecting mirror has, as a reflective surface, at least part of a partial curved surface obtained through (i) forming a curved surface by rotating an ellipse, circle, or parabola around a symmetry axis, serving as a rotation axis, of the ellipse, circle, or parabola and then (ii) cutting the curved surface along a flat surface in which the symmetry axis is contained; said illumination device, further including: a supporting member, having a counter surface facing the reflective surface, for supporting the light emitting element via the counter surface, the optical member being provided on the counter surface.

With the configuration, since the light emitting element and the optical member are provided on the same substrate, it is easy to steadily and exactly provide the light emitting element and the location of the optical member in relation to each other.

Additionally, since the counter surface of the supporting member supports the light emitting element, it is possible to foster, with the supporting member, dissipation of heat generated by the light emitting element. This makes it possible to (i) prevent hypofunction of the fluorescent material light-emitting section 4 due to the heat thus generated and therefore (ii) increase reliability of the illumination device.

Furthermore, a vehicle headlight including the illumination device is encompassed in the technical scope of the present invention.

INDUSTRIAL APPLICABILITY

The present invention is applicable to an illumination device, and particularly to a headlight of a vehicle etc., and is capable of enhancing light utilization efficiency when employed as an illumination device.

REFERENCE SIGNS LIST

1 Headlight (illumination device, vehicle headlight)
2 Laser element (excitation light source)
4 Fluorescent material light-emitting section
4*a* Top surface (predetermined surface)
4*b* Normal line
5 Reflector (reflecting mirror)
5*a* Opening
7 Metal base (supporting member)
7*a* Opening
8 Mini-mirror (optical member)
8*b* Optical axis
8*c* Laser beam reflecting layer
8*d* Laser beam absorbing layer
10 Headlight (illumination device, vehicle headlight)
15 Metal plate (holder)
16 Light converging lens (optical member)
17 Reflecting mirror (optical member)
20 Headlight (illumination device, vehicle headlight)
30 Headlight (illumination device, vehicle headlight)
40 Headlight (illumination device, vehicle headlight)
51 Reflector (Reflecting mirror)

The invention claimed is:

1. An illumination device comprising:

an excitation light source emitting laser light;

a light emitting element comprising a fluorescent material that emits florescent light upon receiving the laser light, the light emitting element having an incident surface and a contact surface opposite from the incident surface, and the laser light being incident on the incident surface;

a reflecting mirror that reflects the fluorescent light emitted from the light emitting element so as to emit the reflected light out of the device; and an optical member that reflects, toward the incident surface of the light emitting element, at least part of light that has not been directed toward the reflecting mirror, the light emitting element being provided substantially at a focal point of the reflecting mirror, and an optical axis of the optical member being inclined with respect to a normal line of the incident surface;

a supporting member supporting the light emitting element and the optical member so that the light emitting element and the optical member are provided on a reflecting-mirror side of the supporting member, the supporting member supporting, on a common surface thereof, the light emitting element and the optical member, the common surface being a flat surface facing a reflective surface of the reflecting mirror, the light emitting element and the optical member being directly mounted on the common surface, the contact surface of the light emitting element is in contact with the common surface so that the fluorescent light is released from the incident surface and not released from the contact surface, and the optical member comprises a layer that reflects the florescent light and absorbs the laser light.

2. The illumination device as set forth in claim 1, wherein the incident surface is a surface having a part facing the reflective surface of the reflecting mirror.

3. An illumination device comprising:

an excitation light source emitting laser light;

a light emitting element comprising a fluorescent material that emits florescent light upon receiving the laser light, the light emitting element having an incident surface and a contact surface opposite from the incident surface, and the laser light being incident on the incident surface;

a reflecting mirror that reflects the fluorescent light emitted from the light emitting element so as to emit the reflected light out of the device; and an optical member that reflects, toward substantially a focal point of the reflecting mirror, at least part of light which has not been directed to the reflecting mirror, the light emitting element being provided substantially at the focal point of the reflecting mirror, and the incident surface faces a reflective surface of the reflecting mirror and is irradiated with light reflected from the optical member;

a supporting member supporting the light emitting element and the optical member so that the light emitting element and the optical member are provided on a reflecting-mirror side of the supporting member, the supporting member supporting, on a common surface thereof, the light emitting element and the optical member, the common surface being a flat surface facing the reflective surface of the reflecting mirror, the light emitting element and the optical member being directly mounted on the common surface, the contact surface of the light emitting element is in contact with the common surface so that the fluorescent light is released from the incident surface and not released from the contact surface, and the optical member comprises a layer that reflects the florescent light and absorbs the laser light.

4. The illumination device as set forth in claim 1, wherein at least part of the light, which is emitted from the light emitting element and is then reflected back from the optical member toward substantially the focal point, is directed toward the reflecting mirror.

5. The illumination device as set forth in claim 1, wherein excitation light, which has not been converted into fluorescence, being reflected back, from the optical member, toward the light emitting element, and being then converted by the fluorescent material into fluorescence.

6. The illumination device as set forth in claim 1, wherein the optical member has a layer that transmits the fluorescence therethrough and reflects the laser beam light.

7. The illumination device as set forth in claim 1, wherein the optical member intersects with (i) a straight line through substantially the focal point and an edge of an opening of the reflecting mirror and (ii) a straight line through a peak of the reflecting mirror and substantially the focal point.

8. The illumination device as set forth in claim 7, wherein a distance between the optical member and substantially the focal point is shorter than a minimum distance between substantially the focal point and the reflecting mirror.

9. The illumination device as set forth in claim 1, wherein the optical member has a concave spherical surface.

10. The illumination device as set forth in claim 1, wherein:

a reflective surface of the reflecting mirror has at least part of a partial curved surface obtained by forming a curved surface by rotating an ellipse, circle, or parabola around a symmetry axis, serving as a rotation axis, of the ellipse, circle, or parabola and by cutting the curved surface along a flat surface in which the symmetry axis is contained;

the surface of supporting member on which the light emitting element and the optical member are provided operates as a counter surface with respect to the reflective surface; and the optical member is provided on the counter surface.

11. A vehicle headlight including an illumination device, the illumination device comprising:

an excitation light source emitting laser light;

a light emitting element comprising a fluorescent material that emits florescent light upon receiving the laser light, the light emitting element having a incident surface and a contact surface opposite from the incident surface, and the laser light being incident on the incident surface;

a reflecting mirror that reflects the fluorescent light emitted from the light emitting element so as to emit the reflected light out of the device; and an optical member that reflects, toward the incident surface of the light emitting element, at least part of light that has not been directed toward the reflecting mirror, the light emitting element being provided substantially at a focal point of the reflecting mirror, and an optical axis of the optical member being inclined with respect to a normal line of the incident surface;

a supporting member supporting the light emitting element and the optical member so that the light emitting element and the optical member are provided on a reflecting-mirror side of the supporting member, the supporting member supporting, on a common surface thereof, the light emitting element and the optical member, the common surface being a flat surface facing a reflective surface of the reflecting mirror, the light emitting element and the optical member being directly mounted on the common surface, the contact surface of the light emitting element is in contact with the common surface so that the fluorescent light is released from the incident surface and not released from the contact surface, and the optical member comprises a layer that reflects the florescent light and absorbs the laser light.

12. An illumination device comprising:

an excitation light source emitting laser light;

a light emitting element comprising a fluorescent material that emits florescent light upon receiving the laser light, the light emitting element having an incident surface and a contact surface opposite from the incident surface, and the laser light being incident on the incident surface;

a reflecting mirror that reflects the fluorescent light emitted from the light emitting element so as to emit the reflected light out of the device; and an optical member that reflects, toward a predetermined surface of the light emitting element, at least part of light that has not been directed toward the reflecting mirror, the light emitting element being provided substantially at a focal point of the reflecting mirror;

a supporting member supporting the light emitting element and the optical member so that the light emitting element and the optical member are provided on a reflecting-mirror side of the supporting member, the supporting member supporting, on a common surface thereof, the light emitting element and the optical member, the common surface being a flat surface facing a reflective surface of the reflecting mirror, the light emitting element and the optical member being directly mounted on the common surface, the contact surface of the light emitting element is in contact with the common surface so that the fluorescent light is released from the incident surface and not released from the contact surface, and the optical member comprises a layer that reflects the florescent light and absorbs the laser light.

13. The illumination device as set forth in claim 3, wherein the optical member has a concave spherical surface.

14. The vehicle headlight as set forth in claim 11, wherein the optical member has a concave spherical surface.

15. The illumination device as set forth in claim 12, wherein the optical member has a concave spherical surface.

* * * * *